US005535838A

United States Patent [19]

Keshavan et al.

[11] Patent Number: 5,535,838

[45] Date of Patent: Jul. 16, 1996

[54] HIGH PERFORMANCE OVERLAY FOR ROCK DRILLING BITS

[75] Inventors: Madapusi K. Keshavan; Kuttaripalayam T. Kembaiyan, both of The Woodlands; Wayne C. Quantz, Kingwood, all of Tex.; Robert C. Tucker, Jr., Brownsburg, Ind.; Melvin D. Mendenhall, Friendswood, Tex.; Jean M. Quets, Indianapolis, Ind.

[73] Assignee: Smith International, Inc., Houston, Tex.

[21] Appl. No.: 250,894

[22] Filed: May 31, 1994

Related U.S. Application Data

[63] Continuation-in-part of Ser. No. 35,136, Mar. 19, 1993, abandoned.

[51] Int. Cl.[6] ..... E21B 10/52

[52] U.S. Cl. ..... 175/374; 427/422

[58] Field of Search ..... 175/374, 425, 175/426, 307; 427/422, 410

[56] References Cited

U.S. PATENT DOCUMENTS

| | | | |
|---|---|---|---|
| 4,396,077 | 8/1983 | Radtke | 175/393 X |
| 4,588,608 | 5/1986 | Jackson et al. | 427/34 |
| 4,593,776 | 6/1986 | Salesky et al. | 175/375 |
| 4,597,456 | 7/1986 | Ecer | 175/371 |
| 4,626,476 | 12/1986 | Londry et al. | 428/457 |
| 4,626,477 | 12/1986 | Jackson et al. | 428/457 |
| 4,679,640 | 7/1987 | Crawford | 175/374 |
| 4,685,359 | 8/1987 | Worthen et al. | 76/108 A |
| 4,708,752 | 11/1987 | Kar | 148/127 |
| 4,781,770 | 11/1988 | Kar | 148/16.5 |
| 4,826,734 | 5/1989 | Jackson et al. | 428/472 |
| 4,836,307 | 6/1989 | Keshavan et al. | 175/374 |
| 5,075,129 | 12/1991 | Jackson et al. | 427/34 |
| 5,279,374 | 1/1994 | Sievers et al. | 175/374 |

*Primary Examiner*—Hoang C. Dang
*Attorney, Agent, or Firm*—Robert G. Upton

[57] ABSTRACT

A method to apply a high performance overlay to a metal substrate of a rock bit to render the substrate surfaces of the rock bit more resistant to erosion, corrosion and substrate cracking while performing in an earthen formation is described. The method comprises the steps of bombarding the surfaces with a thermal spray of entrained fine particles of a cermet based composition at a velocity in excess of 3,000 ft/per sec. The resultant coating of the cermet based composition has a tensile bond strength in excess of 20,000 psi that results in an increase of the strain to fracture of the rock bit surface. The hard overlay has a resistance to severe service environments of high strain and shock tolerance as well as a higher load carrying capacity.

20 Claims, 4 Drawing Sheets

FIG. 1
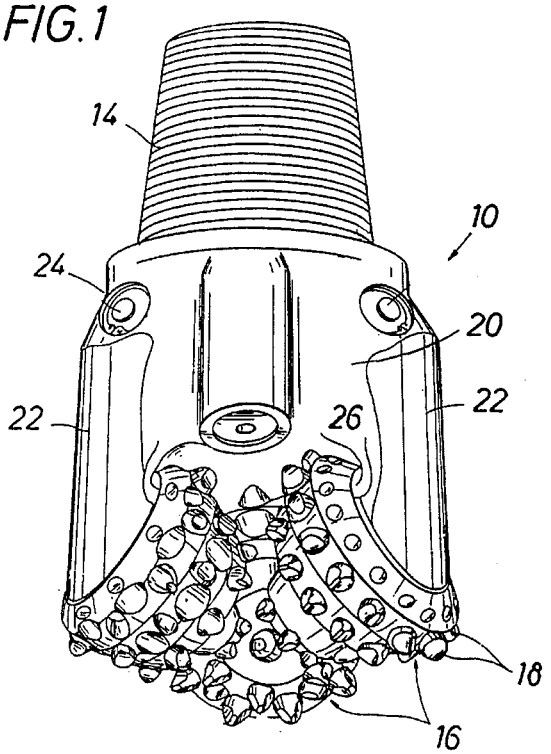
FIG. 3
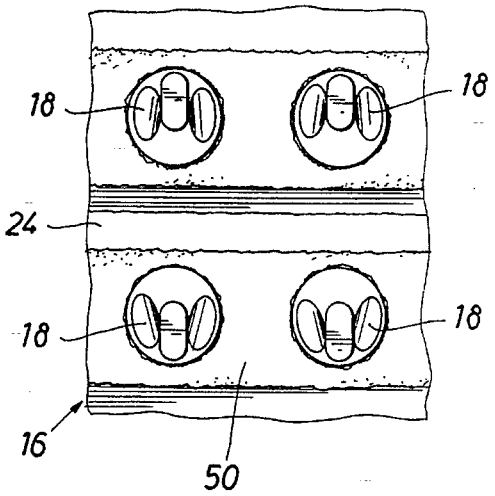
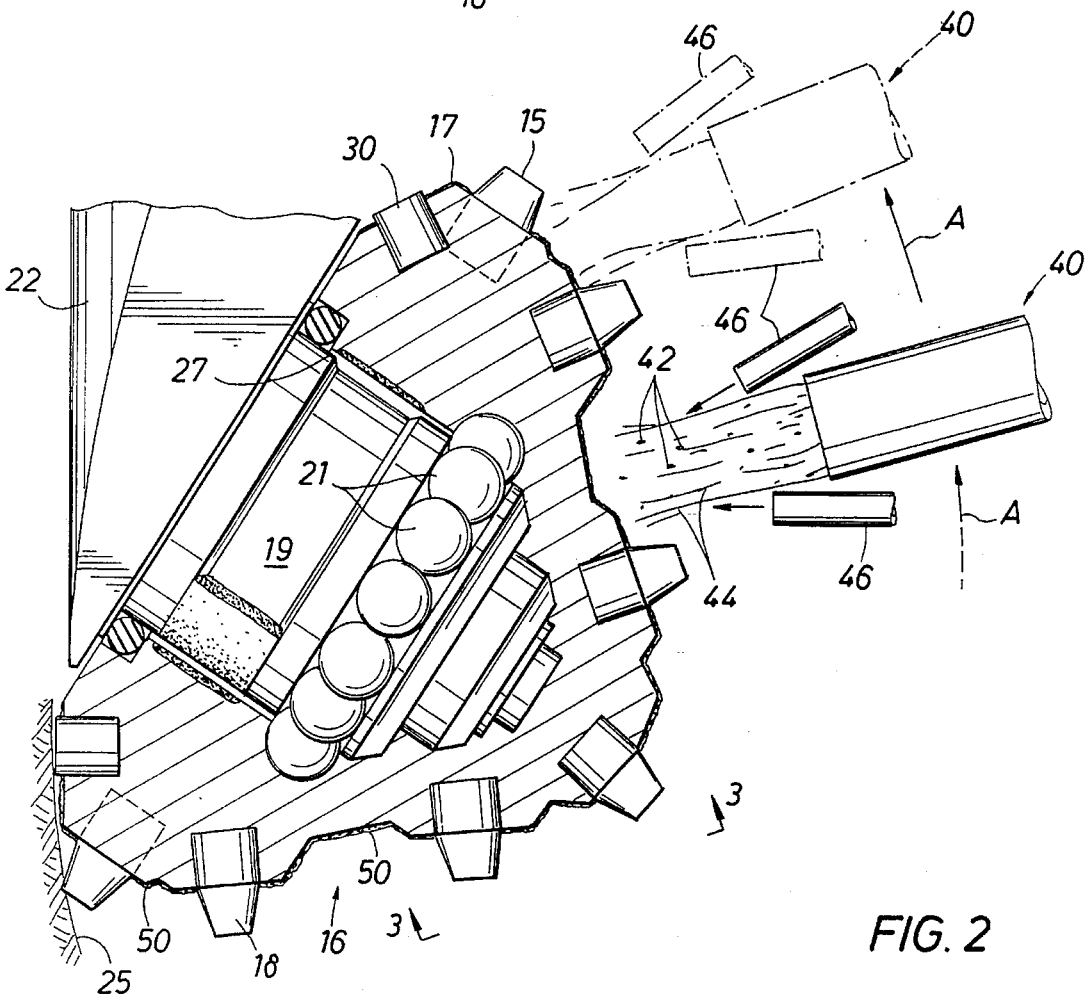
FIG. 2

FIG. 4
| CARBIDE GRADE | MEAN PARTIKLE SIZE (μm) | MEAN FREE PATH (μm) | TRS (ksi) (50%) | HARDNESS (VHN) |
|---|---|---|---|---|
| TCM 406 | 2.22 | 0.25 | 405 | 1600 |
| TCM 411 | 2.09 | 0.45 | 385 | 1370 |
| TCM 510 | 2.30 | 0.45 | 430 | 1260 |
| TCM 614 | 2.80 | 0.80 | 420 | 1050 |
| TCM 616 | 2.50 | 0.84 | 435 | 955 |
| SDG2040 | | - | 140 | 1100 |
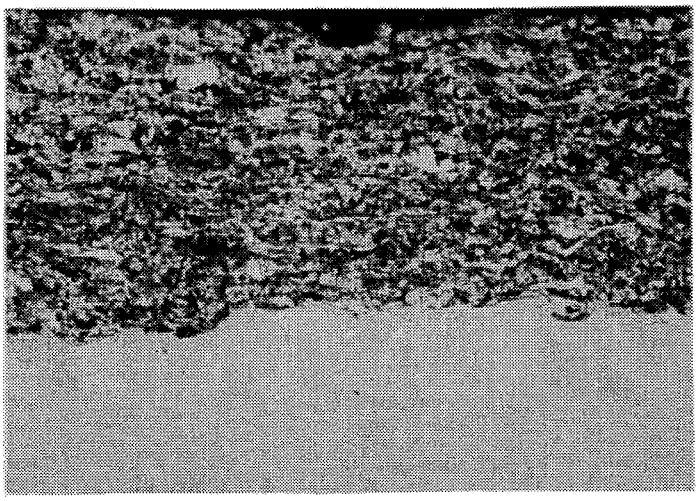
FIG. 5
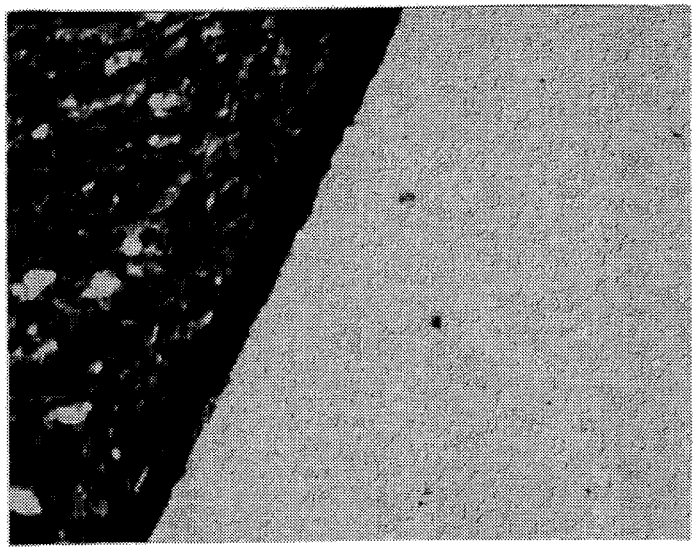
FIG. 6

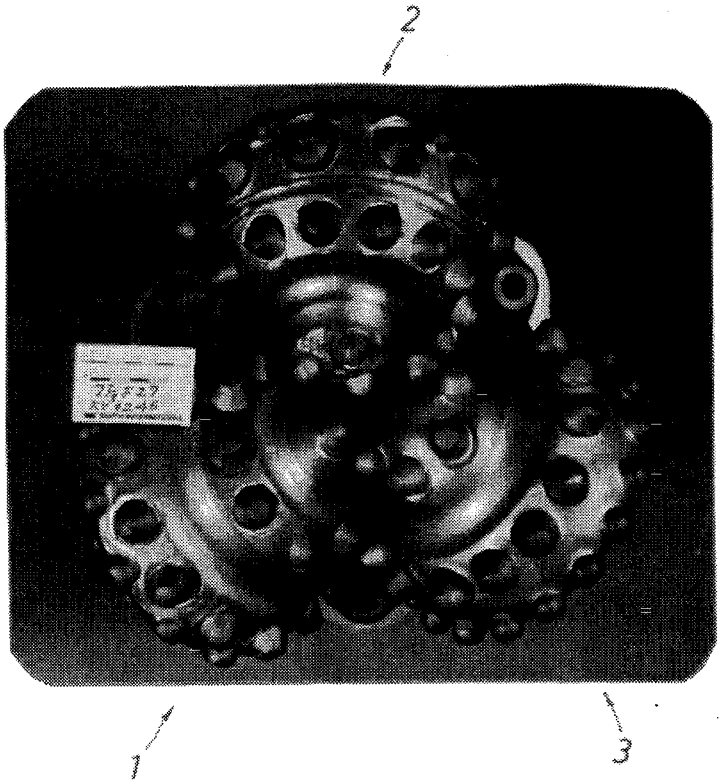
FIG. 7
FIG. 8
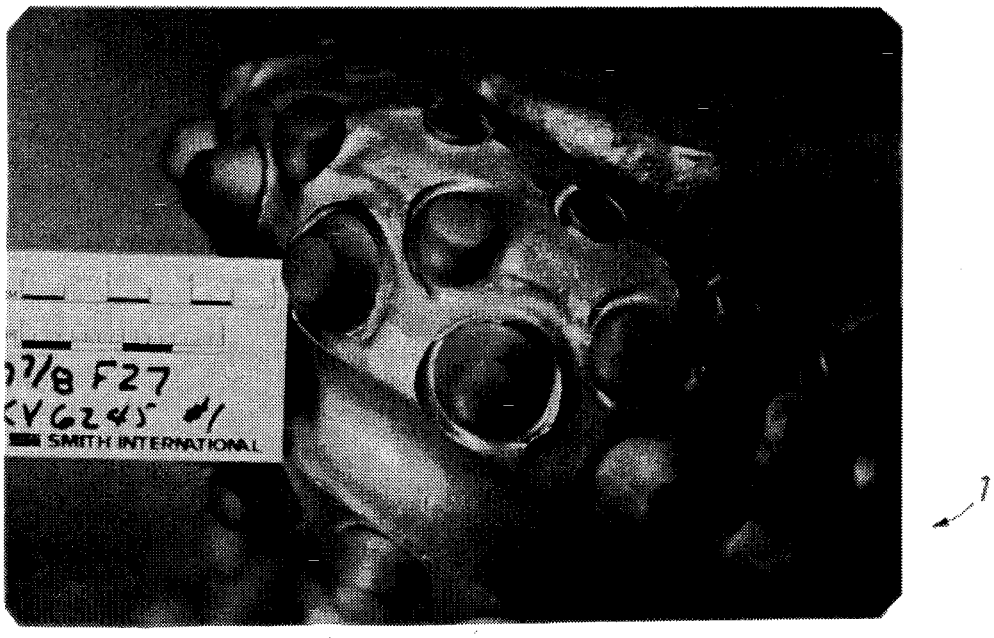

HIGH PERFORMANCE OVERLAY FOR ROCK DRILLING BITS

CROSS-REFERENCE TO RELATED APPLICATION

This application is a continuation-in-part of U.S. patent application Ser. No. 035,136, filed Mar. 19, 1993, now abandoned.

BACKGROUND OF THE INVENTION

I. Field of the Invention

This invention relates to a high performance overlay of the metallic surfaces of rock bit components such as rotary cones, rock bit legs supporting the cones and the exposed surfaces surrounding the cutters mounted within the face of a drag type rock bit.

More particularly, this invention relates to the application of a high performance overlay or coating to the exposed surfaces of steel rotary cones and their supporting legs of rotary cone rock bits. The overlay coating also has an application for the cutting face surrounding diamond cutters mounted within the face of diamond drag rock bits and the like.

II. Background

Hardfacing of rock drilling bit cones for the purpose of inhibiting cone erosion and wear during known harsh rock drilling conditions has been done before with varying degrees of success.

For example, U.S. Pat. Nos. 4,708,752 and 4,781,770 teach the use of lasers to either harden the surface of the rotary cones of a rock bit or entrain a stream of hardfacing material into the laser beam to apply a layer of hardfacing material to the surface of the rotary cones. Both of the foregoing patents are assigned to one of the assignees of the present invention and are incorporated herein by reference.

U.S. Pat. No. 4,685,359 describes a method of manufacturing a steel bodied bit in which a hardfacing of a highly conformable metal cloth containing hard, wear resistant particles is applied to rock bit faces and to the interior of nozzle openings and the like. The cloth known as "CONFORMA CLAD", manufactured by Imperial Clevite, Inc. of Salem, Ind., must first be cut to shape to fit the component to be hardfaced prior to brazing the cloth to the workpiece; a time consuming and difficult process. This method is disadvantaged in that the cloth material, when it is metallurgically attached to the workpiece in a furnace, changes the physical properties of the base material to the detriment of the finished product.

U.S. Pat. No. 5,279,374 describes a method of forming an erosion resistant hard refractory metal coating on a roller bit cone. This patent teaches the method of thermally spraying fine (10 to 33 microns) tungsten carbide powder mixed with 8 to 15 percent by weight cobalt binder powder to form a continuous layer on the outer surfaces of the cone and the sintered carbide drilling inserts entrained thereon. This patent teaches that the adherence of the coating is dependent on the penetration of the metallic matrix of the insert by coating material. While the foregoing method does somewhat inhibit bit cone erosion, it has some serious disadvantages. Any crack initiated in the brittle coating on a carbide insert tends to propagate into the carbide insert substrate reducing the breakage resistance of the insert thereby shortening bit life. Any layer of carbide of significant thickness penetrating the carbide inserts in a bit cone changes the geometry of the inserts making them more blunt. This materially reduces the ability of the inserts to penetrate the rock, thereby reducing the drilling rate of the bit.

The inventors of the present invention have performed extensive field testing of a new type of coating applied to the steel cones of roller type drill bits. This coating is named "Armcore-M" and was developed by Amorphous Technologies International (AMTECH). Armcore-M is basically a mixture of iron, chromium and cobalt powders developed for abrasion and erosion resistance and is covered by U.S. Pat. No. 4,725,512. This coating is applied to a steel substrate using a thermal spray welding technique and it is considered to undergo transformation hardening when stressed or forced into deformation. The results of the aforesaid tests were disappointing in that they were not significantly better in erosion and abrasion resistance than commercially available normal low velocity thermal spray coatings. Even though the Armcore-M coating itself is fairly wear resistant, it does not compare favorably to the ultra high velocity Super D-Gun process coating of the present invention because of its low bond strength to the steel substrate.

U.S. Pat. Nos. 4,826,734 and 5,075,129 describe the basic detonation gun technology and are incorporated herein by reference. In particular, U.S. Pat. No. 4,826,734 teaches the Super D-Gun™ process whereby the overlays produced on rock bit surfaces of the present invention have a hardness of at least 900 $Kg/m^2$ VHN, a strain-to-fracture of about 6.0 mils/inch (0.006") and bond strength that greatly exceed the standard ASTM 633 test strength of about 10,000 PSI.

The Super D-Gun process overlay of the present invention has a nominal composition of 83 weight % tungsten, 14 weight % cobalt and 3 weight % carbon. To achieve the above properties of the coatings of the present invention, it is necessary to accelerate the particulates in the Super D-Gun process to about 3,000 ft/sec. (or greater).

The present invention, using an improved ultra high particle velocity (in excess of 3,000 ft/second) detonation gun thermal spray equipment, produces a monolithic carbide coating that is very strongly adhered to the steel cone surfaces. This includes the areas around and proximate the carbide inserts. The carbide/cobalt spray does not adhere to the carbide inserts because the particles used for coating are much larger than the mean free path of the cobalt binder of the inserts and do not penetrate the binder. But the ultra high velocity of the carbide particles (in excess of 3,000 ft/second) impinging on the protruding carbide inserts does significantly increase the compressive strength of the inserts. It is believed that an effect similar to shot peening induces a significant residual compressive stress in the insert surfaces thereby enhancing the fatigue properties of the inserts.

An improved method of overlaying or coating of rock bit cones and the like is disclosed that incorporates advanced coating materials and application methods.

SUMMARY OF THE INVENTION

It is an object of the invention to provide an improved overlay material for rock bit rotary cones, rock bit legs supporting the cones and the cutting face of drag type rock bits and the like for the purpose of reducing the erosive, corrosive and abrasive effects encountered during rock bit drilling operations.

It is another object of the present invention to utilize an improved detonation gun process to apply a superior overlay material to rock bit components.

It is still another object of the present invention to help prevent cone cracking by the bombardment of the cone surface with the detonation gun during application of the overlay material resulting in residual compressive stresses in the overlay on the surface of the cone.

Yet another object of the present invention is the reduction of residual tensile stress in the tungsten carbide inserts interference fitted within sockets formed in the cone surface.

Still another object of the present invention is the bombardment of the insert cutters during the detonation gun application of the overlay material enabling the inserts to withstand higher compressive loads under operating conditions.

Yet another object of the present invention is minimization of cone cracking between inserts which may be due to hydrogen embrittlement by the application of tungsten carbide utilizing the Super D-Gun process. Hydrogen embrittlement is a process whereby there is an invasion of the hydrogen ion into the highly stressed carburized steel.

U.S. Pat. Nos. 4,826,734 and 5,075,129 describe the basic detonation gun technology and are incorporated herein by reference.

In particular, U.S. Pat. No. 4,826,734 teaches the Super D-Gun process whereby the overlays produced on rock bit surfaces of the present invention have a hardness of at least 900 Kg/mm$^2$ VHN, a strain to fracture of about 6.0 mils/inch (0.006") and bond strength that greatly exceeds the standard ASTM 633 test strength of 10,000 PSI.

The Super D-Gun process overlay of the present invention has a nominal composition of 83 weight % tungsten, 14 weight % cobalt and 3 weight % carbon.

To achieve the above properties of the coatings of the present invention, it is necessary to accelerate the particulates in the Super D-Gun process to about 3,000 ft/sec. (or greater).

The Super D-Gun process is utilized to heat and accelerate a tungsten carbide based powder to a very high velocity and allowing the largely molten and high velocity particles to impinge on a substrate such as a steel cone for a rotary cone rock bit to form a very dense, well bonded overlay. Prior to the Super D-Gun process, the surface of the cones of a rock bit is preferably degreased and grit blasted. Grit blasting roughens the surfaces and renders it slightly uneven which leads to better bonding of the overlay or coating to the cone surfaces. The instantaneous surface temperature on the cone shell while applying the coating is below 400° F. and is maintained below that temperature for less than a minute before the cone is cooled to ambient temperature by, for example, impinging a stream of liquid carbon-dioxide or other coolants unto the cone. The thickness of the coating is between 0.002" and 0.020" on the cone shell. The coating thickness could vary depending on the substrate and particle materials, substrate geometry and application.

A method is disclosed to provide an overlay coating to a metal substrate of a rock bit to render the substrate surfaces of the rock bit more resistant to erosion, corrosion and substrate cracking while performing in an earthen formation comprising the steps of bombarding the surfaces with a thermal spray of entrained fine particles of a cermet based composition at a velocity of at least 3,000 ft per second.

The resultant coating of the cermet composition has a tensile bond strength in excess of 30,000 psi that results in an increase in the strain-to-fracture of the coating because of residual compressive stress.

The overlay coating has a high resistance to severe service environments, a high strain and shock tolerance as well as a higher load carrying capacity.

Subsequent tests have revealed that the coated cones exhibit dramatic increase in cone erosion and corrosion resistance.

An advantage then of the present invention over the prior an is art improved cone with an overlay coating that significantly reduces cone shell erosion.

Another advantage of the present invention over the prior art is the use of the Super D-Gun process for the alleviation of cone cracking by the inducement of compressive residual stresses to the cone surfaces. The Super D-Gun process is especially useful in alleviating those cracks that occur between tungsten carbide inserts pressed into the cones that had, heretofore plagued the rock bit industry.

Another advantage of the present invention over the prior art is the use of the improved overlay that prevents erosion of the cone shell around the inserts by imparting compressive residual stress thereby preventing premature insert loss.

Another advantage of the present invention over the prior art is that the Super D-Gun process increases the compressive strength of the inserts thereby improving the load bearing capacity of the inserts.

Yet another advantage of the present invention over the prior art may be the reduction of hydrogen embrittlement of the highly stressed portions of the cone by the application of tungsten carbide thereon.

The above noted objects and advantages of the present invention will be more fully understood upon a study of the following description in conjunction with the detailed drawings.

BRIEF DESCRIPTION OF THE DRAWINGS

FIG. 1 is a perspective view of a typical three cone rock bit;

FIG. 2 is a cross-section of one of the rotary cones undergoing the hardfacing application process, and FIG. 3 is a view taken through 3—3 of FIG. 2 illustrating a portion of the hardfaced surface of the cone adjacent to each of the tungsten carbide inserts retained therein.

FIG. 4 is a tungsten carbide insert grades and overlay powder comparison chart;

FIG. 5 is a photograph magnified 500 times of a steel cone and a coating of SDG2040 utilizing the Super D-Gun process; and FIG. 6 is a photograph magnified 500 times showing a discontinuous interface between the tungsten carbide insert and the coating.

FIG. 7 is a photograph showing a face view of a field tested roller cone TCI bit (SN KV6245) showing the #1 and #2 cones overlaid with an erosion resistant coating.

FIG. 8 is a photograph of a portion of the #1 cone of bit number KV6245 of FIG. 7 showing all of the carbide inserts still in place and only slight erosion of the cone.

Figure 9:
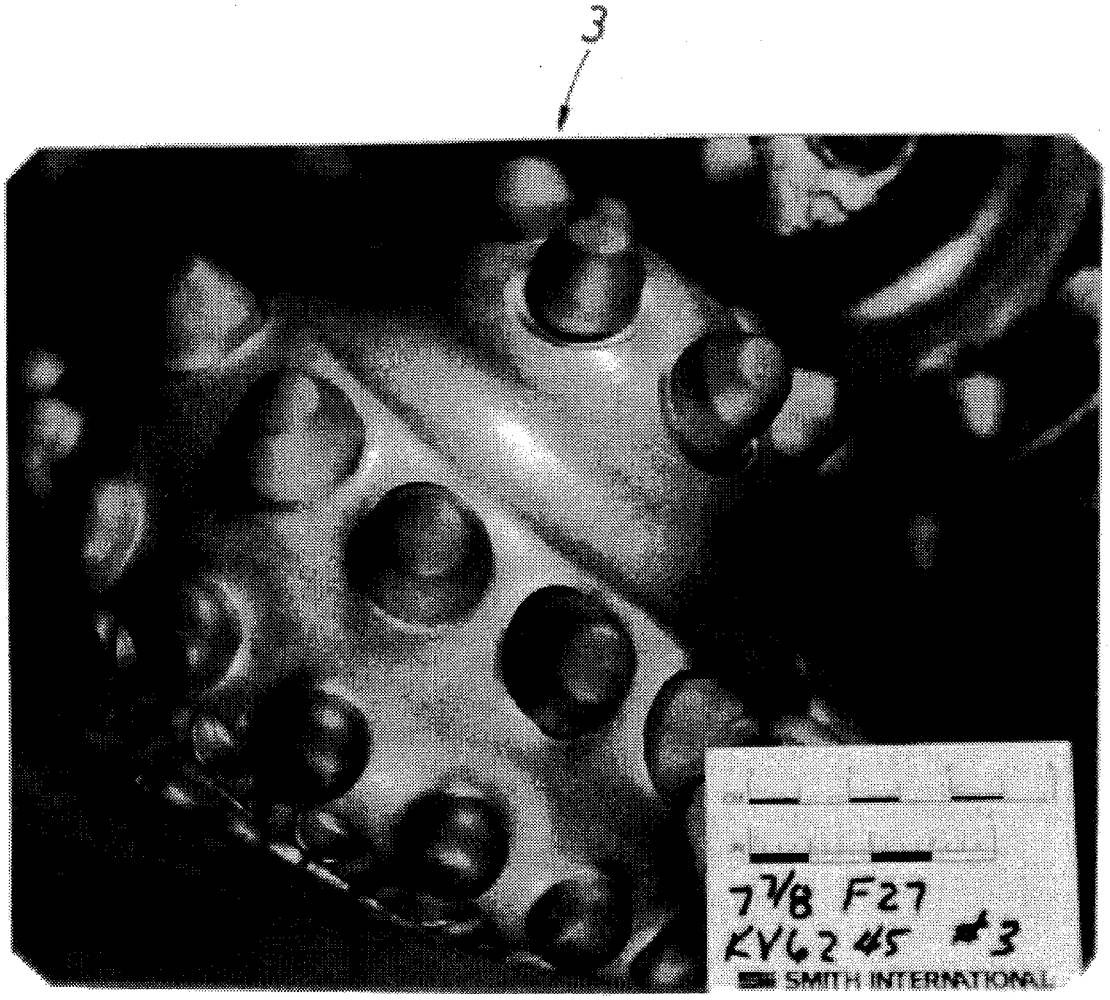
FIG. 9 is a photograph of a portion of the uncoated #3 cone of bit number KV6242 of FIG. 7 showing gross erosion of the cone and lost inserts on the heel row.

DESCRIPTION OF THE PREFERRED EMBODIMENTS AND BEST MODE FOR CARRYING OUT THE INVENTION

Boreholes are commonly drilled with rock bits having rotary cones with cemented carbide inserts interference fitted within sockets formed in the cones. A typical rock bit generally designated as 10 has a steel body 20 with threads 14 formed at an upper end and three depending legs 22 at a lower end. Three cutter cones generally designated as 16 are rotatably mounted on the three legs 22 at the lower end of the bit body 20. A plurality of, for example, cemented tungsten carbide inserts 18 are press-fitted or interference fitted into insert sockets formed in the cones 16. Lubricant is provided to the journals 19 (FIG. 2) on which the cones are mounted from each of three grease reservoirs 24 in the body 20.

When the rock bit is employed, it is threaded unto the lower end of a drill string and lowered into a well or borehole (not shown). The bit is rotated by a rig rotary table with the carbide inserts in the cone engaging the bottom of the borehole 25 (FIG. 2). As the bit rotates, the cones 16 rotate on the bearing journals 19 cantilevered from the body and essentially roll around the bottom of the borehole 25. The weight on the bit is applied to the rock formation by the inserts 18 and the rock is thereby crushed and chipped by the inserts. A drilling fluid is pumped down the drill string to the bottom of the hole 25 and ejected from the bit through nozzles 26. The drilling fluid then travels up the annulus formed between the exterior of the drill pipe and the borehole wall carrying with it, the rock chip detritus. In addition the drilling fluid serves to cool and clean the cutting end of the bit as it works in the borehole.

With reference now to FIG. 2, the lower portion of the leg 22 supports a journal bearing 19 by a plurality of cone retention balls 21 confined by a pair of opposing ball races formed in the journal and the cone. The cone forms an annular heel row 17 positioned between the gage row inserts 15 and bearing cavity 27 formed in cone 16. A multiplicity of protruding heel row insert cutters 30 are about equidistantly spaced around the heel row 17. The protruding inserts 30 and the gage row inserts 15 co-act to primarily cut the gage diameter of the borehole. The multiplicity of remaining inserts in concentric rows crush and chip the earthen formation as heretofore described.

Much of the erosion of the cones typically occurs between the gage row and the heel row inserts 15 and 30. As heretofore described, this type of erosion may result in damage to or loss of the inserts, and cone cracking particularly between the inserts. In highly erosive environments, the whole of the cone body is subjected to severe erosion and corrosion.

The high performance overlay or coating 50 is thermal sprayed unto a rock bit surface and the hard particles are selected from the group consisting of a metal carbide with a metal or metal alloy wherein the coating has a hardness of at least 900 Kg/mm$^2$ Vickers Hardness Number (VHN) but preferably 1,100 Kg/mm$^2$ or higher.

The coating 50 on cone 16 illustrated in FIGS. 2 and 3 is preferably applied by a Super D-Gun process thermal spray method. The thermal spray method shown in a schematic form in FIG. 2 and generally designated as 40 is preferably applied by an apparatus manufactured by Praxair Surface Technologies, Inc., Indianapolis, Ind. and is called, the Super D-Gun process.

The Super D-Gun process is the most advanced thermal spray method of applying metallic, ceramic, and cermet coatings or overlays. Super D-Gun process coatings with extraordinary wear resistance and mechanical properties are the result of heating fine powders of metals, ceramics or cermets to near their melting points and projecting them at extremely high velocities against the surface being coated. Particle velocities generally exceed 3,000 ft/second (915 meters/second). The resulting coatings have a characteristic thermal spray lamellar microstructure, but a density that is very close to theoretical.

The extremely high particle velocities of the Super D-Gun process result in significant advances in coating properties over those of other thermal spray coating systems, even over comparable conventional detonation gun coatings. For example, using a modified Ollard test, tensile bond strengths in excess of 30,000 psi (210 MPa) can be measured. Resistance to abrasive wear, erosive wear and impact fretting wear have all been substantially improved over comparable conventional detonation gun coatings as well as, of course, other thermally sprayed coatings.

Inherent in most thermally sprayed coatings is a residual tensile stress which substantially reduces the strain-to-fracture of such coatings. This, in turn, may lead to drastic reduction in the fatigue characteristics of these coated components. For Super D-Gun process coatings, however, a residual compressive stress, in some cases as high as 50,000 psi (340 MPa) is achieved. As a result, the strain-to-fracture may be as high as 0.8%, while for most conventional detonation gun coatings it may be less than 0.4%. [A strain of 0.8% corresponds to a stress in a coated steel part of 240,00 psi (1,600 MPa) in the part itself]. Even lower values are common to most plasma sprayed and other thermally sprayed coatings. The high strain tolerance of Super D-Gun process coated components permits greater load carrying capacity in both shock and severe service environments. The high strain-to-fracture also strongly influences the effect of a Super D-Gun process coatings on the fatigue strength of substrates. In some cases, no fatigue debit is measurable. In other cases, the fatigue debit is significantly lower than experienced with conventional thermal spray coatings. The as-deposited surface roughness of Super D-Gun process coatings varies with the type of coating from less than 100 to over 200 micro inches Ra (2.5 to 5.0 micro-meter Ra). Although, for many applications, the coating is used as deposited, some are either ground or lapped. Typical coating thicknesses range from about 0.002 to 0.020 inches (0.05 to 0.5 mm), but both thicker and thinner coatings are made without degradation of physical properties.

The foregoing process heats fine powders such as tungsten carbide to near their melting points and projects them at extremely high velocities against the surface to be coated (in the present example, the surface 24 of cone 16). Particle velocities frequently exceed 3,000 ft/sec (915 m/s). Impingement of the entrained tungsten carbide or other desirable mixture of hard particles 42 into surface 24 of the steel bodied cone 16 results in a substantially good bonding that is unparalleled in the industry.

An added benefit is a residual compressive stress which substantially increases the strain-to-fracture of the coatings 50 mechanically bonded to the surface 24 of cone 16.

Typically, the coating thickness ranges from about 0.002 to 0.020 of an inch on the cones 16 and the hardness is around 1,100 Kg/mm$^2$($HV_{300}$).

The Super D-Gun process 40 shown in FIG. 2 in the schematic form is preferably aligned 90 degrees to the surface 24 of the cone 16. The nozzle of the apparatus 40 emits detonation waves of hot gases 44 at very high velocities that entrains, for example, powdered tungsten carbide 42 therein. A fluid substance such as liquid carbon dioxide 46 may be used to cool the cone during the thermal spray process thereby preventing the cones from heating above 400° F. The substrate temperature can be controlled by adjusting the coolant flow and deposition rate. This method of controlling the temperature of the cones prevents tempering of the substrate steel, thereby preventing degradation of the interference fit of the inserts retained within sockets formed in the cone 16 during the thermal spray process.

The cones 16 are preferably cleaned and grit blasted prior to the thermal spray process. This process results in a slightly uneven cone surface 24 resulting in enhancing the bond of the tungsten carbide to the surface. The surface roughness of the cone after grit blasting is typically 200 to 300 micro inches (Ra).

Illustrated in FIG. 2 is the thermal spray apparatus 40 moving to different positions "A" thereby maintaining the nozzle of the apparatus approximately 90° to the surface 24.

FIG. 3 depicts the finished overlay surface 50 that surrounds each of the inserts 18, the overlay material (for example, tungsten carbide-cobalt) is tightly bound to the steel surface 24 and immediately adjacent to each of the inserts 18.

The uniform application of the overlay material through the use of the Super D-Gun process assures an erosion resistant surface as well as a means to essentially prevent cone cracking because of the residual compressive stresses on the outer surface of the cones.

The detonation gun process comprises carefully measured gases, usually consisting of oxygen and a fuel gas mixture that are fed into a barrel of the gun along with a charge of fine tungsten carbide-based powder. The SDG2040 coating, a proprietary overlay developed by Praxair Surface Technologies, Inc., Indianapolis, Ind., is mainly a mixture of tungsten carbide with about 15 wt % cobalt binder. The gas is ignited in the Super D-Gun process barrel and the resulting detonation wave heats and accelerates the powder as it moves down the barrel. The gas velocity and density are much higher than in a conventional detonation gun. The powder is entrained for a sufficient distance for it to be accelerated to its extraordinary velocity and virtually all of the powder to become molten. A pulse of inert nitrogen gas is used to purge the barrel after each detonation. The process is repeated many times per second. Each detonation results in the deposition of a circle (pop) of coating material, a few microns thick on the surface 24 of the rock bit cone 16. The total coating, of course, consists of many overlapping pops. The precise and fully automated pop placement results in a very uniform coating thickness of the overlay material 50 and a relatively smooth and planar surface on the cones 16.

The microstructure of the overlay consists of a lamellar interleaving "splats", or solidified droplets of powder material. Bonding to the metallic cone face between the inserts is generally considered to be largely due to a mechanical interlocking of the overlay with the grit blasted cone surface. There is no significant bonding, however, to the inserts as shown in the photograph of FIG. 6. Since virtually all of the powder material used in the present invention becomes molten in the detonation process, it cannot penetrate even the relatively soft cobalt phase in the insert.

Reference is now made to the chart of FIG. 4 which depicts the properties of tungsten carbide insert and coating materials. The mean particle size of most of the usable carbide grades in the drilling applications is in the range of 2–3 microns. The mean free path, which is the average thickness of the binder phase (cobalt in most of the cases) between the tungsten carbide particles, is in the range of 0.1 to 1.0 microns in these carbide grades. The mechanical properties of the tungsten carbide insert is superior in comparison with that of the coating and thus, any chemical reaction between these two is undesirable for the performance of the carbide inserts.

FIG. 5 is a photograph illustrating the adhesion of the SDG2040 coating on the steel substrate. It shows a continuous, nonporous and good bonding of the coating material (SDG2040) on the substrate steel (E9313). The coating particles are well interlocked unto the base steel and there is no evidence of any interfacial cracks or discontinuity.

FIG. 6 shows clearly a lack of adhesion of the SDG2040 on the tungsten carbide insert. There is a discontinuous coating on the insert, however, the interface between the coating and the surface of the insert is distinctly separate without any physical or mechanical interlock. The cracks and voids in the interface indicate that the coating has not adhered to the insert and will delaminate at the slightest provocation.

It is common practice in the drilling industry to use experimental roller cone drill bits in actual wells being drilled by an oil and gas company. To ensure that any change made in materials or design is evaluated objectively, the change is made on two of the three roller cones with the remaining cone being left standard. This assures that all three cones have been exposed to the same drilling environment.

FIG. 7 is a photograph of a three cone drill bit, serial number KV6245. In this bit, cones 1 and 2 are overlaid with Super D-Gun process coating and number 3 cone is standard with no coating. Several bits were so constructed and field tested. The bit shown in FIG. 7 is typical of all the bits tested. It is clear from this picture that cone number 3 suffered a great deal of cone shell erosion around all carbide inserts wherein the coated number 1 and 2 cones remained essentially free of erosion.

FIG. 8, which is an enlarged photograph of cone number 1 of the bit illustrated in FIG. 7, Cone number 1 shows little or no cone shell erosion clearly illustrating the erosion resistance of the Super D-Gun process coating.

FIG. 9 is also an enlarged photograph of the standard number 3 cone of the above bit. This cone has no coating and the severe cone erosion is evident. Most of the steel substrate around the inserts in the nose row and heel row has been eroded away. As a result, all of the heel row inserts were lost in the borehole.

A substrate of a rock bit, such as a steel cone or a steel face of a diamond drag rock bit, may be coated with a tungsten carbide cobalt layer having a strain-to-fracture greater than $4.3\times10^{-3}$ inch per inch and a Vickers hardness of greater than about 875 $HV_{0.3}$. without departing from the scope of this invention.

Moreover, the tungsten carbide-cobalt layer may have a strain-to-fracture from about $4.5\times10^{-3}$ to $10\times10^{-3}$ inch per inch and a Vickers hardness of greater than about 900 $HV_{0.3}$ or a strain-to-fracture greater than $5.3\times10^{-3}$ inch per inch and a Vickers hardness of greater than about 1,000 $HV_{0.3}$. The thickness also may range from about 0.0005 to about 0.1 inch thick.

Additionally, the tungsten carbide-cobalt layer may have a content of cobalt from about 7 to about 20 weight percent, a carbon content from about 0.5 to about 6 weight percent and tungsten content from about 74 to 92.5 weight percent without departing from the scope of this invention.

It would be obvious to utilize various ceramics or metals with the thermal spray detonation process without departing from the scope of this invention.

It would be obvious to utilize various hard particles such as ceramics selected from the group consisting of metallic, oxides, carbides, nitrides or mixtures or alloys thereof.

It is also obvious that the coating binder metal which generally is cobalt, may also be nickel, iron or mixtures or alloys of the three metals. Chromium in amounts up to 8% weight percent may also be added.

Another embodiment of the present invention consists of applying a Super D-Gun process hard material overlay on the steel drilling head surface of a polycrystalline diamond compact (PDC) insert type drill bit. This hard material overlay greatly reduces the detrimental erosion of the drill bit head around the PDC inserts mounted thereon. This erosion is caused by the high velocity abrasive drilling fluid that is pumped across the bit face. Uncoated steel and state of the art thermal spray coatings are unsatisfactory as they erode too rapidly thereby losing PDC inserts prematurely terminating bit life.

While all of the examples given here utilize the Super D-Gun overlay process, any other thermal spray process that achieves the same velocities and thermal content may be used even though they may not have been developed as yet.

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

What is claimed is:

1. A rock bit for drilling boreholes, said rock bit having at least one cutter insert in a cutting surface formed by the bit, at least some of the rock bit exposed surfaces overlaid with a coating to resist erosion, corrosion and cracking while performing said coating comprising;

a layer of hard particles with a suitable binder being thermal sprayed onto said surfaces of said rock bit and said at least one cutter insert at a velocity in excess of 3,000 ft/sec wherein impinging particles from said high velocity thermal spray process do not penetrate the at least one cutter insert.

2. The invention as set forth in claim 1 wherein said binder is selected from the group consisting of iron, nickel, cobalt and mixtures or alloys thereof.

3. The invention as set forth in claim 1 wherein said layer of hard particles have a tensile bond strength in excess of 20,000 psi.

4. The invention as set forth in claim 1 wherein the hard particles in the coating is selected from the carbides of the group consisting of tungsten, zirconium, tantalum, chromium, titanium and mixtures or alloys thereof.

5. The invention as set forth in claim 4 wherein the hard particles are tungsten carbide.

6. The invention as set forth in claim 5 wherein the tungsten carbide is combined with cobalt, nickel, iron or mixtures or alloys thereof.

7. The invention as set forth in claim 6 wherein the tungsten carbide is combined with cobalt.

8. The invention as set forth in claim 7 wherein the cobalt content is from about 7 to about 20 weight percent and the carbon content is from about 0.5 to about 6 weight percent and the tungsten content is from about 74 to 92.5 weight percent.

9. The invention as set forth in claim 1 wherein the hard particles is a ceramic selected from the group consisting of metallic oxides, carbides, nitrides and mixtures and alloys thereof.

10. The invention as set forth in claim 1 wherein the surfaces are bombarded with a thermal spray of hard particles exiting from an nozzle formed by a Super D-Gun process.

11. The invention as set forth in claim 10 wherein the surfaces of the rock bit to be hardfaced are rotary cutter cones of a rotary cone rock bit.

12. The invention as set forth in claim 11 wherein the cutter cones contain a multiplicity of strategically positioned tungsten carbide inserts retained within sockets formed in the cones, the cones being bombarded by said Super D-Gun process with the inserts secured in the cones, said inserts benefit from the peening effect of said bombardment, said bombardment imparts residual compressive stress in the insert, said hardfacing serving to inhibit erosion and corrosion around the inserts thereby minimizing loss or destruction of the inserts as the rock bit works in a borehole.

13. The invention as set forth in claim 12 wherein the mean size of the particles used in the high velocity process is in the range of 2 microns and 44 microns, the free mean path of the binder material in the carbide insert is in the range from 0.1 to 1.0 microns.

14. The invention as set forth in claim 1 wherein the thickness of the layer of hard particles on said surface is between 0.002 and 0.020 of an inch.

15. The invention as set forth in claim 1 whereto the hardness of the layer of hard particles is at least 900 $Kg/mm^2$ ($HV_{300}$).

16. A method to overlay a coating of material to a steel cone of a rock bit to render the surfaces of the rock bit more resistant to erosion, corrosion and substrate cracking while performing in an earthen formation comprising the steps of:

bombarding said cone and tungsten carbide inserts retained therein with a thermal spray of entrained fine hard particles at a velocity in excess of 3,000 ft/sec, said bombardment of the inserts resulting in peening effect and imparting a residual compressive stress in said inserts; coating said cone and inserts in a layer of said hard particles, said coating having a tensile bond strength in excess of 20,000 psi that results in an increase of the strain-to fracture of the rock bit surfaces through a residual compressive stress, the layer of hardfacing having a resistance to severe service environments, a high strain and shock tolerance as well as a higher load carrying capacity; and preventing the hard particles from penetrating a cobalt binder material of the tungsten carbide inserts whereby there is no bond formed at an interface between the impinging hard particles and a surface formed by said inserts, said penetration is prevented by the impinging hard particles being significantly larger than the free mean path of the cobalt binder of said inserts.

17. A rock bit for drilling boreholes, said rock bit having at least some of its exposed surfaces coated with a coating to resist erosion, corrosion and cracking while performing in said boreholes, said rock bit further comprising;

at least one tungsten carbide insert secured within said exposed rock bit surfaces, said coating comprising a layer of hard particles with a suitable binder being thermal sprayed onto said surfaces of said rock bit by a high velocity thermal spray process at a velocity in excess of 3,000 ft/sec, the hard particles bombarding an exposed surface of the insert to peen the surface of the insert resulting in residual compressive stress in said at least one insert without penetration of an exposed surface of said insert resulting in a higher load carrying capacity by said at least one insert.

18. The invention as set forth in claim 17 wherein said at least one tungsten carbide insert is inserted within an insert hole formed by said exposed surface of said rock bit, the retention of the insert in said rock bit surface being improved as a result of said residual compressive stress in said overlaid coating surrounding said insert.

19. The invention as set forth in claim 17 wherein said layer of hard particles have a tensile bond strength in excess of 20,000 psi that results in an increase in the strain-to-fracture of the rock bit surfaces through residual compressive stress.

20. The invention as set forth in claim 17 wherein said layer of hard particles have a tensile bond strength in excess of 20,000 psi that results in an increase in the strain-to-fracture of the surface of the at least one tungsten carbide insert through residual compressive stress resulting in increased load carrying capacity of the at least one insert.

* * * * *